United States Patent [19]

Raffel

[11] 4,105,024

[45] Aug. 8, 1978

[54] MASSAGING FURNITURE

[76] Inventor: Marvin J. Raffel, 9010 N. 70th St., Milwaukee, Wis. 53223

[21] Appl. No.: 797,218

[22] Filed: May 16, 1977

[51] Int. Cl.[2] ..... A61H 1/00

[52] U.S. Cl. ..... 128/33; 128/41

[58] Field of Search ..... 128/33, 24.1, 24.2, 128/41, 42, 43

[56] References Cited

U.S. PATENT DOCUMENTS

| | | | |
|---|---|---|---|
| 3,446,204 | 5/1969 | Murphy | 128/33 |
| 3,457,910 | 7/1969 | Vecchio | 128/24.2 |
| 3,556,088 | 1/1971 | Leonardini | 128/33 |
| 3,653,375 | 4/1972 | Raffel | 128/33 |
| 3,765,407 | 10/1973 | Prince | 128/41 |
| 3,854,474 | 12/1974 | Carruth | 128/41 |
| 4,005,703 | 2/1977 | Rosen | 128/41 |

*Primary Examiner*—Lawrence W. Trapp
*Attorney, Agent, or Firm*—Wheeler, Morsell, House & Fuller

[57] ABSTRACT

Nonrotating vibrator motors are mounted on a rigid member in furniture. Electric power at different frequencies or energy levels is supplied to the respective vibrator motors. Frequency differences in the vibrations result in moving interference waves being produced in the rigid member which waves are imparted to the user of the furniture who experiences a massaging effect. Means are provided for enabling the user to control the frequency differential and amplitudes of the driving currents.

11 Claims, 5 Drawing Figures

MASSAGING FURNITURE

BACKGROUND OF THE INVENTION

This invention relates to improvements in furniture which is equipped with motors for producing vibrations which result in the user of the furniture experiencing a massaging effect.

A prior type of massaging furniture, particularly a chair, is disclosed in U.S. Pat. No. 3,653,375, dated Apr. 4, 1972, owned by the inventor of this application. In this patent, a pair of rotating electric motors are mounted to a rigid closed frame which is part of the chair. The motors are on opposite sides of the closed frame and have eccentric weights on their shafts. This causes the motors to vibrate during operation and to impart vibrations to the frame and, hence, to the user of the chair. The cited patent also discloses the concept of operating the motors at different speeds so they vibrate at different frequencies. The frequencies are selected such that interference waves are set up in the rigid member. This results in a soothing body massage being imparted to the user.

Although the above outlined massage furniture is basically satisfactory, it is not optimized in all respects. The best results are obtainable if the vibrational frequencies of the motors and, hence, their differential frequencies, are held within a comparatively small range under control of the user. Unfortunately, available small rotary motors exhibit speed variations as great as 10% or even more even if they are supplied from a constant and stable power supply. This inherent speed variation is often greater than the desired frequency differential between the motors which the user of the furniture is trying to establish by use of the electric controls.

Another disadvantage of rotating vibratory motors is that they have bearings which are subject to wearing and to freezing in which case their life might be terminated sooner than the life of the furniture itself. The cost of electric motors is also significant.

In accordance with the present invention, massaging furniture is equipped with nonrotating vibrating motors which are controlled to produce moving interference waves in the furniture. There have been some prior devices intended for contact with the human body in which only one nonrotating vibrating motor is used. Such prior devices are incapable of producing the interference waves which result in the subtle massaging effect which is desired. U.S. Pat. No. 2,920,618 discloses a vibratory therapeutic cushion in which a single nonrotating vibratory motor is used. The motor is mounted on a diaphragm which allows large amplitude vibrations to be produced which would probably not be suitable for furniture. U.S. Pat. No. 2,921,578 discloses a nonrotating vibratory motor wherein the vibrations are imparted to resilient springs in a chair structure. U.S. Pat. No. 2,943,621 discloses a vibratory motor mounted in a tube within a pillow. U.S. Pat. No. 3,043,294 shows a vibratory foot massaging machine with a nonrotating vibratory motor mounted on a diaphragm type footrest. U.S. Pat. No. 3,765,400 shows an exercising stand which has a spring mounted platform and a pair of motors for oscillating the platform up and down and sideways, respectively.

SUMMARY OF THE INVENTION

In general terms, the invention involves fixing a plurality of nonrotating vibratory motors upon a base or frame of a furniture structure. Each motor is supplied with pulsating electric power. Means are provided for setting the pulse rate or frequency of the power supplies. In use, the frequencies are adjusted to produce a frequency differential between them which results in interference waves being produced in the part of the furniture structure on which the motors are mounted. Parts of the furniture on which the user rests conduct the massage waves to the user who experiences a massaging effect.

An object of this invention is to provide for more precise control of the interference wave vibrational frequency in massaging furniture by using nonrotary vibratory motors which will follow the frequencies of their impressed pulsed driving currents more precisely.

Further objects are to use nonrotating vibratory motors in interference wave massaging furniture to obtain optimum stability, simplicity, economy and reliability of the interference wave producing system.

How the foregoing and additional objects of the invention are achieved will appear in the ensuing more detailed description of a preferred embodiment of the invention which will now be set forth in reference to the drawing.

DESCRIPTION OF A PREFERRED EMBODIMENT

Figure 1:
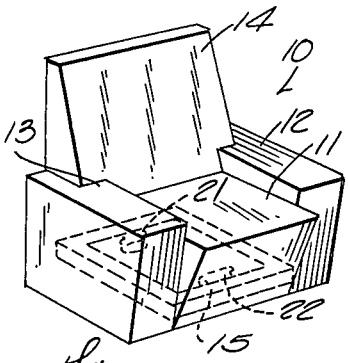
FIG. 1 is a perspective view of a chair in which the nonrotating vibratory motors and the part of the furniture structure on which they are mounted are shown in hidden lines.
Figure 2:
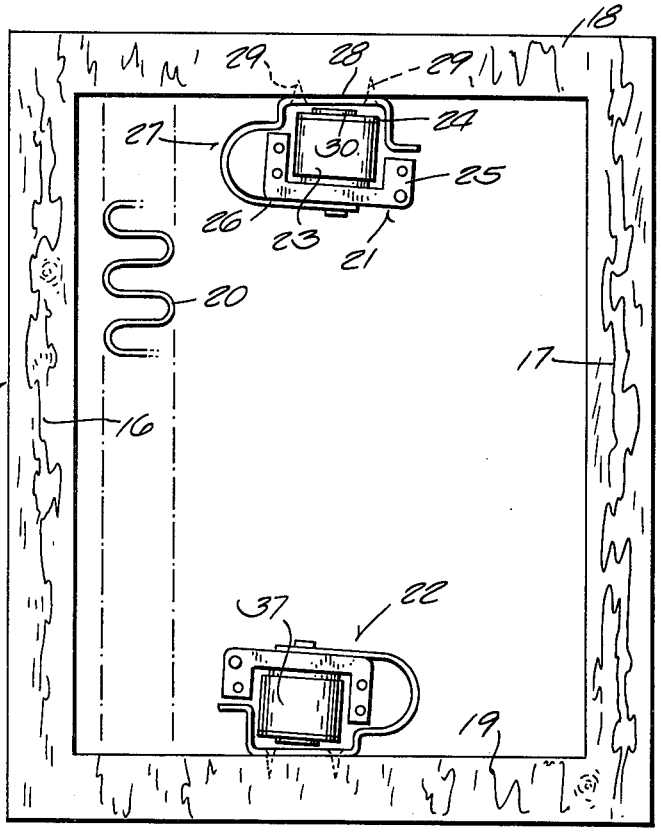
FIG. 2 is a plan view of a chair frame or base having nonrotating vibratory motors mounted thereon.

FIG. 1 shows a chair 10 having a seat 11, sides and armrests 12 and 13 and a backrest 14. Most of the chassis or frame structure on which the chair is built has been omitted for the sake of clarity. A rigid frame or base 15 is, however, shown in hidden lines. An isolated view of frame 15 is shown in FIG. 2. It comprises side members 16 and 17 and end members 18 and 19. These members may be connected at their ends by any suitable means such as screws or glue or both, not shown, to form them into a closed rigid frame. Several zig-zag sag-resistant springs such as the one marked 20 may be fastened at opposite ends to frame members 18 and 19 in a conventional manner. The frame and springs may participate in transmitting the interference waves to a cushion or other part of the furniture.

In this embodiment, a pair of nonrotating vibratory motors 21 and 22 are mounted to end members 18 and 19, respectively, of the frame 15. Nonrotating vibratory motor 21 is typical. It comprises a coil 23 wound on an insulating spool 24. The spool is fitted onto the middle leg of an E-shaped laminated magnet core 25. Core 25 is secured to one arm 26 of a U-shaped armature 27 formed of resilient metal. The other arm 28 of the U-shaped armature is fastened to frame member 18 with any suitable means such as with screws 29. The center leg of the E-shaped frame constitutes a pole piece 30. When coil 23 is energized with pulsating electric current, pole piece 30 is repeatedly attracted toward magnetic arm 28 under the influence of the magnetic field and separated from the arm under the influence of the resilient U-shaped armature. This repeated and rapid reversal in the direction of the mass which is constituted by coil 23, core 25 and pole piece 30 imparts a corresponding vibrational movement to the members comprising frame 15.

In accordance with the invention, means are provided for enabling a user of the furniture to control the vibrational frequency of at least one of the motors 21 or 22 and cause a difference in their vibrational frequencies which results in development of the interference waves in the rigid furniture frame that were mentioned earlier. The use may select a frequency and driving current amplitude that provides the desired massage wave speed and intensity that the user desires at any time.

Figure 4:
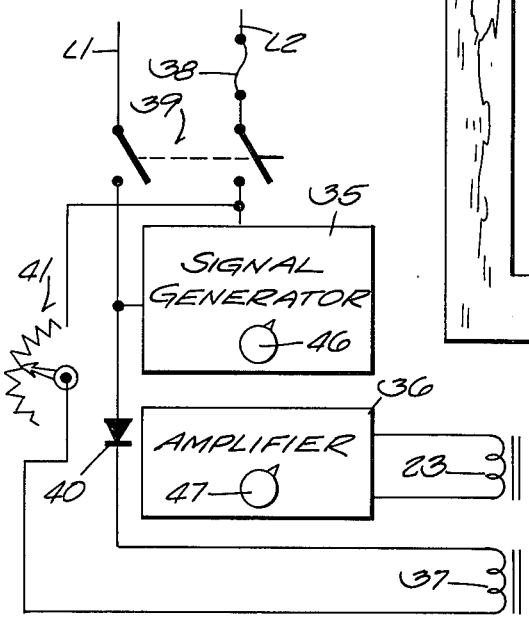
FIG. 4 is a schematic diagram of the electric circuitry for operating and controlling the vibratory motors.

FIG. 4 is a schematic diagram of a typical power supply system for the vibratory motors. As shown, the power supply includes a signal generator 35 and an amplifier 36. At least one signal generator for one motor should be adapted for varying its pulse rate or frequency within limits. Signal generator 35 may, in accordance with the invention, be adapted to produce signals of various waveforms such as sine waves, square waves, sawtooth waves, triangular waves as continuous wave signals or pulse signals. The pulse rate or frequency of the signal generator should be such that the difference between the frequency of the signals it delivers to one vibratory motor and the signals delivered to the other vibratory motor enables production of interference waves in the range of about 1 to 30 cycles per second. Amplifying or varying the amplitude of the signals is optional. As is well known to those skilled in the electronics arts, however, circuits for signal generators which permit controlling frequency, pulse rate, width and amplitude are readily available. Because of the wide variety of circuits that are available, it is deemed unnecessary to describe any one in particular.

In FIG. 4, the coil for vibratory motor 21 is marked 23 as it is in FIG. 2, and the coil for vibratory motor 22 is marked 37. Coil 37 may be supplied with various forms of pulses at any random frequency, usually in the range of 1 to 100 Hz. or pulses per second, but not necessarily limited to these values, using any suitable power source such as, but not limited to, the type marked 35 in FIG. 4. In this illustrative embodiment, coil 37 is supplied with half-wave rectified current derived from the 60 Hz. alternating current power lines L1 and L2. There is a fuse 38 in one of the power lines. There is also a main line two-pole switch 39. The circuit for operating one vibratory motor coil 37 on pulsating or half-wave rectified current includes a diode 40, coil 37 amd a variable resistor 41. These elements are connected in series across a-c lines L1 and L2. Variable resistor 41 permits the user to vary the amplitude of the unipolar pulses and, hence, the vibrational force imparted to the chair by one of the motors but the pulse rate or frequency depends on the power line frequency. The pulsed waveform which is applied to coil 37 as a result of using rectifying diode 40 is shown in part D of FIG. 5. The applied positive pulses are shown in solid lines and are typified by pulses 42 and 43. The negative portions of the sine waves which are removed by half-wave rectification are shown in dashed lines and two of them in the continous train of pulses are marked 44 and 45 in part D of FIG. 5. Thus, it will be seen that the pulse rate or frequency of the current applied to coil 37 of vibratory motor 22 will be 60 pulses per second if the alternating power supply frequency is 60 Hz. This is a good basic frequency for the signals applied to one motor coil such as 37 because it allows a differential interference wave frequency of 1 to 30 Hz. to be obtained by operating the other coil 23 in a desirable range of the basic frequency plus or minus 30 Hz.

Coil 23 of nonrotating motor 21 may be supplied with various forms of pulses, usually at a different frequency than the pulses applied to coil 37. As mentioned earlier, signal generator 35 may be a sine, triangular, sawtooth or square wave generator. If control over the energy in the individual pulses or waves is desired, the output signals from generator 35 may be amplified as with amplifier 36 or the integrated energy of the pulses or waves may be varied or controlled by controlling their width. The signal rates or frequency and amplitudes are adjustable at the will of the operator by turning knobs 46 and 47 on the signal generator 35 and amplifier 36, respectively. These knobs are on potentiometers, not shown, in the generator and amplifier. The amplifier may be omitted if the generator is adapted for energy control by pulse height or pulse width modulation in addition to frequency control.

Figure 5:
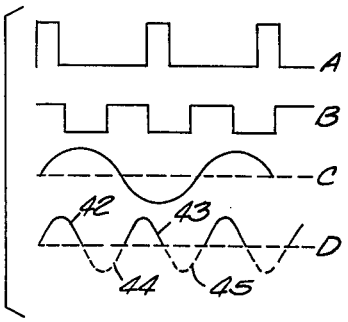
FIG. 5 shows some waveforms, marked A–D, which facilitate explaining the operating mode of the massaging system.

The waveform for an adjustable frequency pulse train from signal generator 35 which may be applied to motor coil 23 is shown in part A of FIG. 5. As shown, this selected waveform has a pulse rate or frequency less than the frequency of the half-wave rectified pulse train in part D of FIG. 5. The amplitudes of the vibrations caused by the pulses depends on pulse energy which is a function of the integrated area of the pulses. The area and, hence, the energy may be varied by altering pulse width or pulse height.

Part B of FIG. 5 is a selected pulse waveform which may be applied to one vibratory motor coil, such as the one marked 23, while half-wave rectified pulses as in part D are applied to the other motor coil 37. Part B is illustrative of varying the width and amplitude of the pulses compared with part A and also varying the pulse frequency by increasing it in this example compared to the frequency in part D. The square pulse waveforms in parts A and B of FIG. 5 are presented to illustrate the principles of varying pulse width, rate and amplitude in comparison with each other and with part D but it should be understood that the same principles would be involved if the waveforms were triangular, sawtooth or sinusoidal or of other forms.

Part C of FIG. 5 is a waveform which may be applied to one vibratory motor coil, such as the one marked 23, while pulses of the forms shown in part D of FIG. 5, for example, are applied to motor coil 37. The waveform in part C is shown as a regular sine wave having a frequency of about 31 Hz. Using the type of motors shown in FIG. 1, the vibration frequency of motor 21 will be 62 Hz. while that of motor 22 will be 60 Hz. resulting in a differential frequency of 2 Hz. Hence, the moving interference wave frequency represented by the difference between the two frequencies will also be 2 Hz. In accordance with the invention, of course, the frequency of the sine wave in part C may be raised or lowered by the user of the furniture to obtain the desired massaging effect as in the previously discussed exmamples. It should be understood that the vibratory motors need not be positioned exactly as shown in FIGS. 2 and 3 although the best massage action will be obtained if they are positioned generally as shown.

Figure 3:
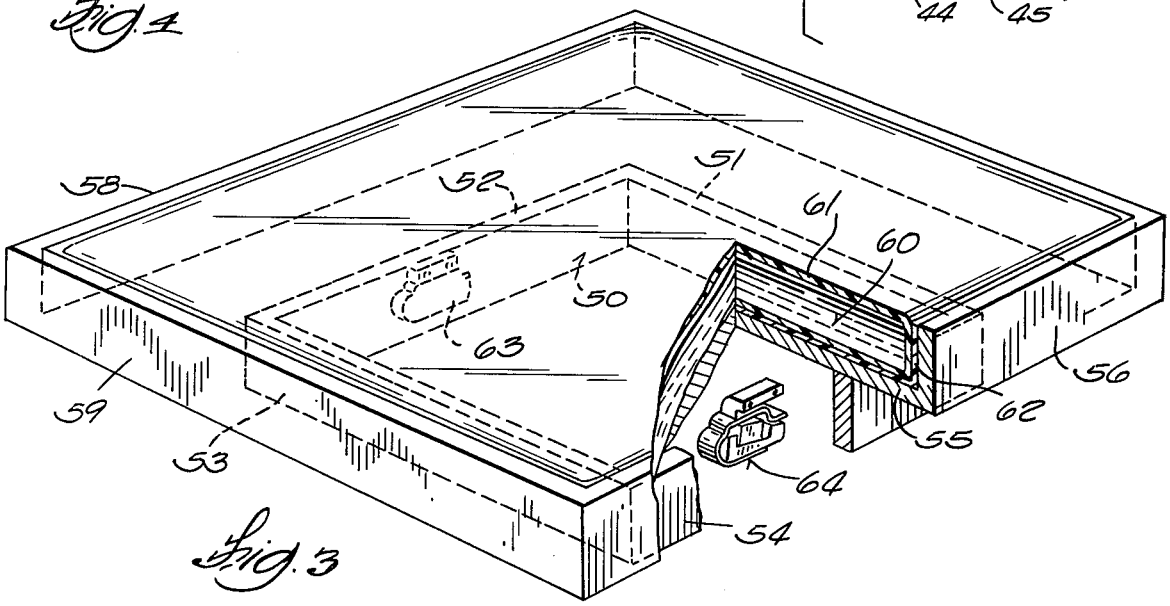
FIG. 3 is a perspective view of a water bed in which the new massaging system is installed, part of the bed being broken away to show the inner details.

FIG. 3 illustrates a water bed to which the differential frequency nonrotating vibrator motor system is applied. The water bed comprises a pedestal 50 which is formed by four members 51, 52, 53 and 54 which are joined to form corners. Pedestal 50 may be supported on the floor of a room. Supported on top of pedestal 50 is a rigid platform panel 55, usually of plywood, to which is fastened framing or upstanding side members 56–59. The side members and rigid platform panel 55 are arranged to form a recess in which a water bed mattress 60 is disposed. The mattress comprises a casing 61 of flexible plastic material. A plastic open topped liner 62 is interposed between the mattress and its supporting frame to capture water in the event the mattress leaks. The heater which is usually present under water beds is not shown.

In accordance with the invention, a pair of nonrotating vibratory motors 63 and 64 are fastened to the bottom of platform panel 55. Although the best massage action will be obtained with the motors positioned as shown, the motors could be mounted in other places. In any case, the vibratory motors in the water bed application should be mounted so that when they are operated at different frequencies they will set up interference waves in platform panel 55 for transmission to the platform panel and from the panel to the mattress 60.

A power supply and control system analogous to that described in connection with FIGS. 4 and 5 and the chair application of the invention in FIG. 2 may be used with the water bed of FIG. 3.

Although the new nonrotating vibratory motor system for producing interference waves in furniture has been described in detail, such description is intended to be illustrative rather than limiting, for the invention may be variously embodied and is to be limited only by interpreting the claims which follow.

I claim:

1. In massaging furniture:

rigid means defining a closed path for conducting vibratory waves, a plurality of nonrotating vibratory motors for imparting vibrations to said rigid means, said motors each including a core, a magnet coil on said core, an armature and, means coupling said core and armature for vibrating relative to each other and for yieldingly holding them apart, one of said core and said armature of each motor being secured to said rigid means and the other being free to vibrate and impart said vibrations to said rigid means, means for energizing the coil of one of said motors with electric signals at a first frequency to thereby produce vibratory waves at one frequency in said path in said rigid means, means for energizing the coil of another of said motors with electric signals at a second frequency to thereby produce vibratory waves at a second frequency in said path for coacting with waves of said first frequency to result in production of interference waves in said rigid means, and means for varying at least one of said frequencies so as to vary the frequency of the resulting interference waves and, thus, the massaging wave frequency.

2. The furniture as in claim 1 wherein said means for energizing said coil with electric signals at said first frequency comprises a circuit for being connected across a source of sinusoidal alternating current, said circuit including said coil, variable resistor means and a unidirectionally conducting means for rectifying said alternating current to produce said pulses.

3. The furniture as in claim 1 wherein said means for energizing said coil with electric signals at said second frequency includes means for controlling the energy of said signals.

4. The furniture as in claim 1 wherein said means for energizing said coil with electric signals at said second frequency comprises means for generating substantially square wave pulses and means for controlling the rate of said pulses.

5. The furniture as in claim 4 including means for controlling the energy of said substantially square wave pulses.

6. The furniture as in claim 1 wherein said means for energizing said coil with electric signals at said second frequency comprises means for generating unrectified sinusoidal alternating current signals.

7. The furniture as in claim 6 including means for controlling the energy of said signals.

8. The furniture as in claim 1 wherein said rigid means is a frame comprising a first pair of spaced apart elongated members, a second pair of spaced apart elongated members in general parallelism with each other and disposed generally perpendicular to said first pair and fastened thereto, said nonrotating vibratory motor means being mounted to said frame.

9. The furniture as in claim 1 including cushion means supported by said frame.

10. The furniture as in claim 1 wherein the difference between the frequencies of the signals for energizing said motors is in the range of 1 to 30 cycles per second.

11. The furniture as in claim 1 wherein said rigid means comprises platform means for being disposed in a horizontal position to support a water bed thereon, said plurality of motor means being mounted to said platform means, said platform means providing said closed path for conducting said vibratory waves.

* * * * *